US011753891B2

(12) United States Patent
Alexander et al.

(10) Patent No.: US 11,753,891 B2
(45) Date of Patent: Sep. 12, 2023

(54) CASING MILL, METHOD, AND SYSTEM

(71) Applicants: David Alexander, Houston, TX (US); Andrew Ponder, Houston, TX (US); Knut Inge Dahlberg, Tomball, TX (US)

(72) Inventors: David Alexander, Houston, TX (US); Andrew Ponder, Houston, TX (US); Knut Inge Dahlberg, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/499,471

(22) Filed: Oct. 12, 2021

(65) Prior Publication Data

US 2023/0113994 A1 Apr. 13, 2023

(51) Int. Cl.
*E21B 29/00* (2006.01)
*E21B 10/32* (2006.01)

(52) U.S. Cl.
CPC ..... *E21B 29/005* (2013.01); *E21B 10/32* (2013.01)

(58) Field of Classification Search
CPC ..... E21B 10/32; E21B 29/005
See application file for complete search history.

(56) References Cited

U.S. PATENT DOCUMENTS 2,899,000 A * 8/1959 Medders ..... E21B 29/005 166/55.8
5,297,630 A * 3/1994 Lynde ..... B23B 5/16 166/55.6
5,735,359 A 4/1998 Lee et al.
10,267,111 B2 4/2019 Hart et al.
2009/0321063 A1* 12/2009 Bryant, Jr. ..... E21B 29/005 166/55.7
2013/0199785 A1* 8/2013 Hekelaar ..... E21B 29/005 166/55.7

(Continued)

OTHER PUBLICATIONS

Notification of Transmittal of the International Search Report and the Written Opinion of the International Searching Authority, or the Declaration; PCT/US2022-046004; dated Feb. 9, 2023; 10 pages.

*Primary Examiner* — Christopher J Sebesta
*Assistant Examiner* — Lamia Quaim
(74) *Attorney, Agent, or Firm* — CANTOR COLBURN LLP

(57) ABSTRACT

A casing mill including a first milling configuration having a first blade for milling a first casing section, and a second milling configuration having a second blade, the second blade being an ultra-high expansion blade for milling a second casing section. A wellbore system including a borehole in a subsurface formation, two nested casings disposed within the borehole, a string disposed within the casings, a casing mill disposed within or as a part of the string and including a first milling configuration having a first blade for milling a first casing section, and a second milling configuration having a second blade, the second blade being an ultra-high expansion blade for milling a second casing section, the second casing section being radially outwardly disposed of the first casing section, and a stroking tool disposed between the first milling configuration and the second milling configuration.

10 Claims, 3 Drawing Sheets

(56) References Cited

U.S. PATENT DOCUMENTS

| | | | | |
|---|---|---|---|---|
| 2014/0124202 | A1 | 5/2014 | Beynon | |
| 2014/0231087 | A1 | 8/2014 | Orstad | |
| 2016/0245032 | A1 | 8/2016 | Hekelaar et al. | |
| 2018/0100373 | A1* | 4/2018 | Krüger | E21B 47/005 |
| 2021/0095538 | A1 | 4/2021 | Segura et al. | |

* cited by examiner

CASING MILL, METHOD, AND SYSTEM

BACKGROUND

In the resource recovery and fluid sequestration industries, there is often need to mill casings. One example of the above is a plug and abandonment operation. Various means and methods exist for milling casing but since overall efficiency of tools and methods is paramount to operational profitability, the industry will well receive improved mills, methods, and systems.

SUMMARY

An embodiment of a casing mill including a first milling configuration having a first blade for milling a first casing section, and a second milling configuration having a second blade, the second blade being an ultra-high expansion blade for milling a second casing section, the second casing section being radially outwardly disposed of the first casing section.

An embodiment of a wellbore system including a borehole in a subsurface formation, two nested casings disposed within the borehole, a string disposed within the casings, a casing mill disposed within or as a part of the string and including a first milling configuration having a first blade for milling a first casing section, and a second milling configuration having a second blade, the second blade being an ultra-high expansion blade for milling a second casing section, the second casing section being radially outwardly disposed of the first casing section, and a stroking tool disposed between the first milling configuration and the second milling configuration.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
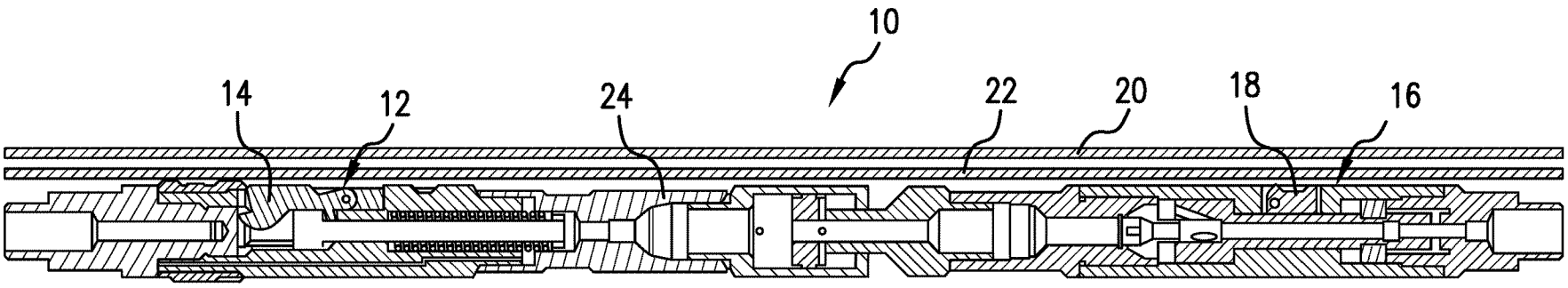
FIG. 1 is a cross sectional view of a casing mill as disclosed herein in a running position.
Figure 2:
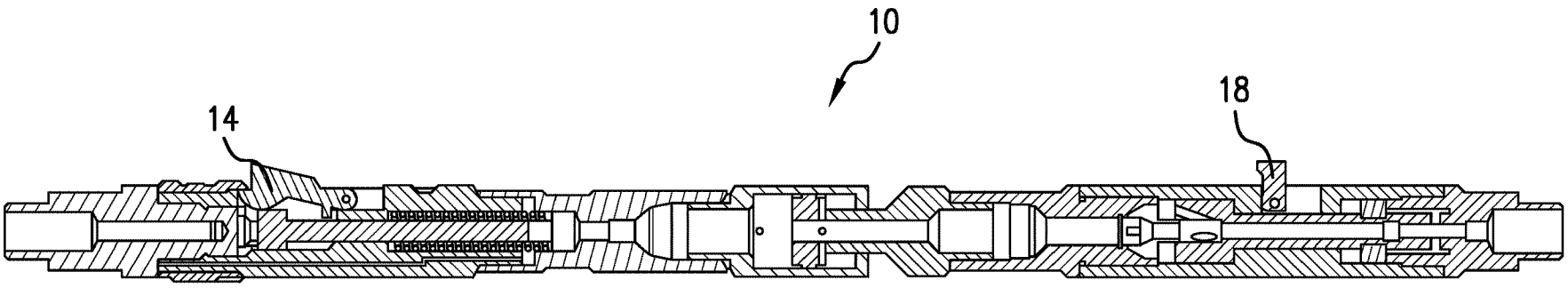
FIG. 2 is a cross sectional view of a casing mill as disclosed herein in a milling position.

Referring to FIG. 1, a casing mill 10 is illustrated having a first milling configuration 12 having a blade 14 and a second milling configuration 16 having an ultra-high expansion second blade 18. The first blade 14, in embodiments may be configured for radial and axial milling or only axial milling. If the first blade 14 is restricted to axial milling then a preexisting window will be needed to start the casing window extension process. The second blade is an ultra-high expansion blade (such as an AMT™ Section Mill or Perseus' Cutter commercially available from Baker Hughes). The term "ultra-high expansion" when referencing a blade as used herein means a blade that extends well past an outer diameter of a first casing string encountered by the extending blade. In embodiments, the ultra-high expansion blade extends to reach a second casing string radially outwardly positioned of the first casing string. This second blade 18 may, in embodiments, be configured for radial and axial milling or only axial milling but regardless of being one or both, will always be an ultra-high expansion blade. The second blade 18 is required to reach and mill a second casing 20 radially outwardly of a first casing 22 within which the casing mill 10 is disposed, which can be appreciated from perusal of FIG. 2. Between the first milling configuration 12 and the second milling configuration 16 is a stroking tool 24, similar to the stroking tool used in Baker Hughes product number H14036. The stroking tool 24 provides for a caterpillaring movement of the first and second milling configurations. This movement is employed when the casing mill 10 is being used in a mode where the first blade and second blades 14 and 18 are milling sequentially rather than simultaneously. Specifically, one of the first blade and the second blade will mill its respective casing 20 or 22 first and then the stroking tool will stroke and facilitate the other of the first and second blades 14 and 18 cutting its respective casing 20 or 22. In one example, the milling configuration 12 will mill the casing 22 for a distance and then the stroking tool 24 will stroke, pulling milling configuration 16 with it and milling the casing 20. The stroking tool 24 will then expand while the milling configuration 12 mills another length of the casing 22, whereafter the stroking tool 24 will again draw the milling configuration 16 closer to the milling configuration 12 while milling the casing 20 with the second milling configuration 16. This process may be repeated over and over until the milled window is of a desired length.

In embodiments, the casing mill 10 is run after a window has been milled and requires only the axial cutting blades 14 and 18. This may be a preexisting window for some other purpose, or may be a window milled specifically for the casing mill 10 to be used to extend that window to a desired length.

As should be appreciated from the above, milling with the casing mill 10 may be by simultaneously milling casing 20 and casing 22 with different blades (14 and 18) or may be milled sequentially using the stroking tool 24, whereby rotational torque drag is minimized relative to the simultaneous milling operation.

Figure 3:
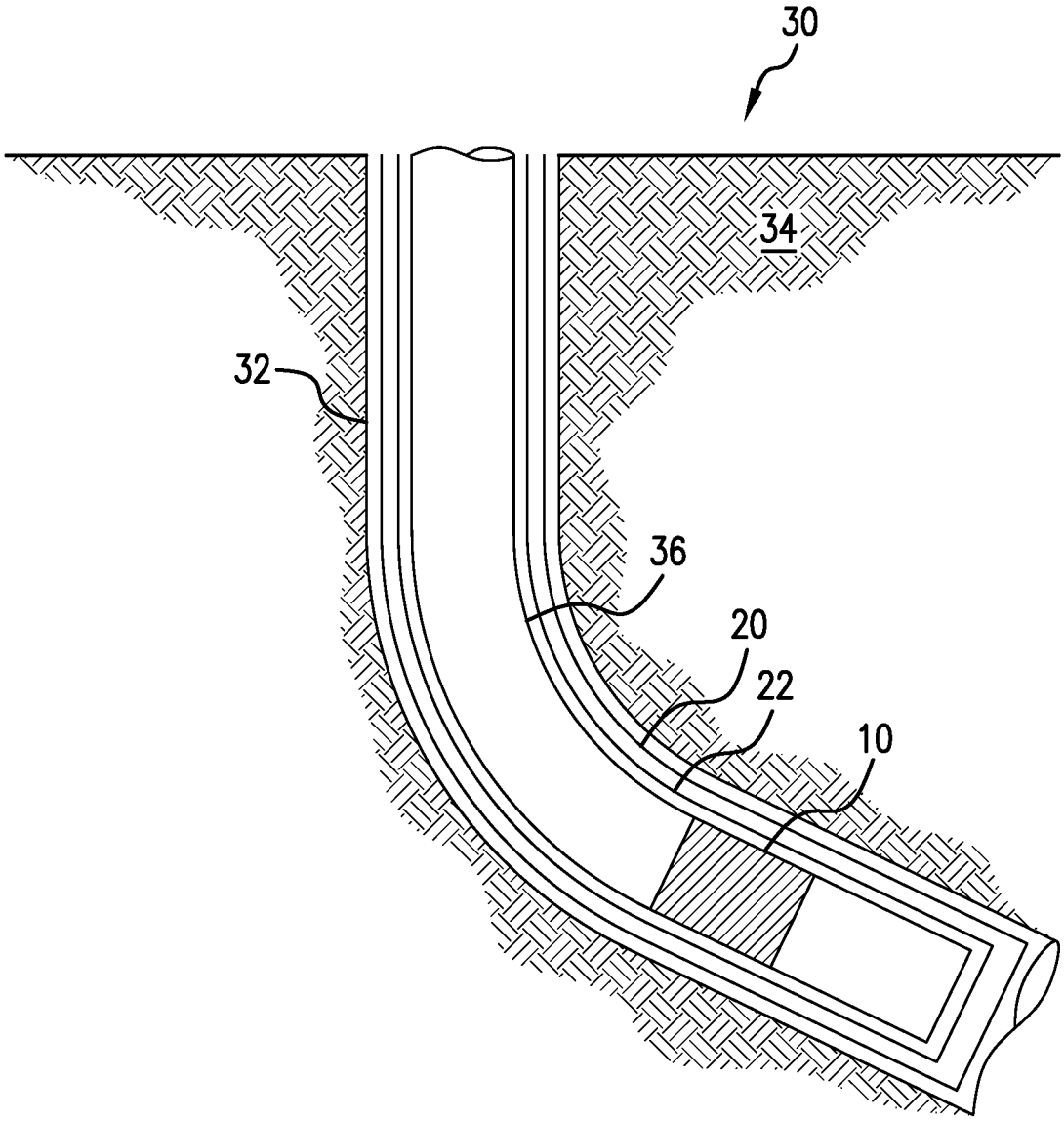
FIG. 3 is a view of a wellbore system including the casing mill disclosed herein.

Referring to FIG. 3, a wellbore system 30 illustrated. The system 30 includes a borehole 32 in a subsurface formation 34. Two casings 20 and 22 are disposed within the borehole 32 and a casing mill 10 is disposed within or as a part of a string 36 disposed within the casing 22

Set forth below are some embodiments of the foregoing disclosure:

Embodiment 1: A casing mill including a first milling configuration having a first blade for milling a first casing section, and a second milling configuration having a second blade, the second blade being an ultra-high expansion blade for milling a second casing section, the second casing section being radially outwardly disposed of the first casing section.

Embodiment 2: The mill as in any prior embodiment wherein a stroking tool is disposed between the first milling configuration and the second milling configuration.

Embodiment 3: The mill as in any prior embodiment wherein the stroking tool facilitates milling one of the first casing section or the second casing section exclusive of the other of the first casing section or the second casing section.

Embodiment 4: The mill as in any prior embodiment wherein the first blade is configured to mill radially outwardly through the first casing and then axially along the first casing.

Embodiment 5: The mill as in any prior embodiment wherein the second blade is configured to mill radially outwardly through the second casing and then mill axially along the second casing.

Embodiment 6: The mill as in any prior embodiment wherein the first and second blades are configured only to mill axially of the first and second casings, respectively.

Embodiment 7: A method for milling both of a first casing radially outwardly of a second casing and the second casing including running a mill as in any prior embodiment, milling the first casing, and milling the second casing simultaneously with the first casing.

Embodiment 8: The method as in any prior embodiment wherein the casing mill is positioned at a pre-opened window.

Embodiment 9: The method as in any prior embodiment wherein the casing mill is positioned at a selected depth and opens a window.

Embodiment 10: The method as in any prior embodiment wherein the first milling configuration opens a window in the first casing and the second milling configuration is delayed in operation until the second milling configuration is in register with the window milled by the first milling configuration prior to the simultaneous milling of the first and second casings.

Embodiment 11: A method for milling both of a first casing radially outwardly of a second casing and the second casing including running a mill as in any prior embodiment, milling one of the first casing or the second casing, actuating the stroke tool, and while stroking, milling the other of the first casing or the second casing.

Embodiment 12: A wellbore system including a borehole in a subsurface formation, two nested casings disposed within the borehole, a string disposed within the casings, a casing mill disposed within or as a part of the string and including a first milling configuration having a first blade for milling a first casing section, and a second milling configuration having a second blade, the second blade being an ultra-high expansion blade for milling a second casing section, the second casing section being radially outwardly disposed of the first casing section, and a stroking tool disposed between the first milling configuration and the second milling configuration.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A casing mill comprising:

a first milling configuration having a first blade for milling a first casing section; and a second milling configuration having a second blade, wherein the first blade and the second blade are longitudinally spaced apart, the second blade being an ultra-high expansion blade for milling a second casing section, the second casing section being radially outwardly disposed of the first casing section, the casing mill being configured to cut the first and second casing with the first and second milling configuration, respectively, simultaneously.

2. The mill as claimed in claim 1 wherein a stroking tool is disposed between the first milling configuration and the second milling configuration.

3. The mill as claimed in claim 1 wherein the first blade is configured to mill radially outwardly through the first casing and then axially along the first casing.

4. The mill as claimed in claim 1 wherein the second blade is configured to mill radially outwardly through the second casing and then mill axially along the second casing.

5. The mill as claimed in claim 1 wherein the first and second blades are configured only to mill axially of the first and second casings, respectively.

6. A method for milling both of a first casing radially outwardly of a second casing and the second casing comprising:

running a mill comprising:

a first milling configuration having a first blade for milling a first casing section; and a second milling configuration having a second blade, wherein the first blade and the second blade are longitudinally spaced apart, the second blade being an ultra-high expansion blade for milling a second casing section, the second casing section being radially outwardly disposed of the first casing section;

milling the first casing; and milling the second casing simultaneously with the first casing.

7. The method as claimed in claim 6 wherein the casing mill is positioned at a pre-opened window.

8. The method as claimed in claim 6 wherein the casing mill is positioned at a selected depth and opens a window.

9. The method as claimed in claim 6 wherein the first milling configuration opens a window in the first casing and the second milling configuration is delayed in operation until the second milling configuration is in register with the window milled by the first milling configuration prior to the simultaneous milling of the first and second casings.

10. A wellbore system comprising:

a borehole in a subsurface formation;

two nested casings disposed within the borehole;

a string disposed within the casings;

a casing mill disposed within or as a part of the string and including a first milling configuration having a first blade for milling a first casing section; and a second milling configuration having a second blade, wherein the first blade and the second blade are longitudinally spaced apart, the second blade being an ultra-high expansion blade for milling a second casing section, the second casing section being radially outwardly disposed of the first casing section, the casing mill being configured to cut the first and second casings with the first and second milling configurations, respectively, simultaneously.

* * * * *